United States Patent [19]

Schneider, Jr.

[11] 3,962,598

[45] June 8, 1976

[54] MEANS FOR RESTRICTING MOVEMENT OF A SHADOW MASK IN A DIRECTION TRANSVERSE TO THE LONGITUDINAL AXIS OF A COLOR CATHODE RAY TUBE

[75] Inventor: Rudolph R. Schneider, Jr., Syracuse, N.Y.

[73] Assignee: GTE Sylvania Incorporated, Stamford, Conn.

[22] Filed: Apr. 16, 1973

[21] Appl. No.: 351,462

[52] U.S. Cl. ..... 313/406; 313/407

[51] Int. Cl.[2] ..... H01J 29/02; H01J 29/07

[58] Field of Search ..... 313/85 S, 404, 406, 313/467

[56] References Cited

UNITED STATES PATENTS

| | | | |
|---|---|---|---|
| 2,727,172 | 12/1955 | Mark et al. | 313/85 S |
| 3,449,611 | 6/1969 | Schwartz et al. | 313/292 X |
| 3,454,813 | 7/1969 | Lewinson | 313/292 X |

*Primary Examiner*—Robert Segal
*Attorney, Agent, or Firm*—Norman J. O'Malley; William H. McNeill; Cyril A. Krenzer

[57] ABSTRACT

Brackets mounted on the frame of a shadow mask extend into the space between the wall of the frame and the wall of the face plate of a color cathode ray tube. In the event of transverse movement of the frame, such as from a physical shock, the bracket contacts the stud in the side wall and limits permissable movement of the frame, thus preventing damage to the fragile mask.

5 Claims, 4 Drawing Figures

MEANS FOR RESTRICTING MOVEMENT OF A SHADOW MASK IN A DIRECTION TRANSVERSE TO THE LONGITUDINAL AXIS OF A COLOR CATHODE RAY TUBE

BACKGROUND OF THE INVENTION

This invention relates to color television picture tubes of the shadow mask variety and more particularly to such a tube incorporating therein means for preventing or at least substantially reducing damage to the fragile shadow mask caused by physical shocks such as might occur during shipping of the completed tube. Color picture tubes of the type discussed herein generally comprise a face plate portion in the form of a dish with an upstanding circumferential wall. A cathodoluminescent screen of patterned phosphors emissive of different colors of light is formed on the interior of the face plate and a shadow mask, to aid in color selection, is releasably mounted in the face plate, adjacent to the screen but spaced therefrom. A funnel portion is attached to the face plate and terminates in a neck which contains one or more electron guns for providing a stream or streams of electrons to energize the phosphors, all as is well understood in the art.

The shadow mask usually employed in this type of tube comprises a relatively fragile foraminated mask portion which is attached to a relatively rigid frame. Mounting within the face plate is generally accomplished by means of a plurality of leaf springs attached to the frame which have an apertured free end which engages a stud or similar projection on the interior of the face plate. This mounting is necessary because insertion and removal of the mask is accomplished a number of times as the screen is being fabricated; however, particularly when a three point suspension is being utilized, this type of mounting allows substantial movement of the mask in a direction transverse to the longitudinal axis of the tube when the tube is subjected to physical shocks. Since modern tubes present a rectangular format and the tubes are shipped in packing cartons wherein a short side of the tube is down, such shocks occur frequently during shipping with sufficient severity to cause damage to the fragile mask, which results in the tube being unacceptable for use in a color television receiver.

OBJECTS AND SUMMARY OF THE INVENTION

It is, therefore, an object of this invention to obviate the disadvantages of the prior art.

It is another object of the invention to enhance the art of making color picture tubes.

Still another object of the invention is the substantial prevention of mask damage caused by transverse shocks during shipping of color picture tubes.

These objects are accomplished in one aspect of the invention by the inclusion in a picture tube of means associated with the short sides of the shadow mask for substantially restricting movement of the mask in a direction transverse to the longitudinal axis of the tube.

DESCRIPTION OF THE PREFERRED EMBODIMENTS

For a better understanding of the present invention, together with other and further objects, advantages and capabilities thereof, reference is made to the following disclosure and appended claims in conjunction with the above-described drawings.

Figure 1:
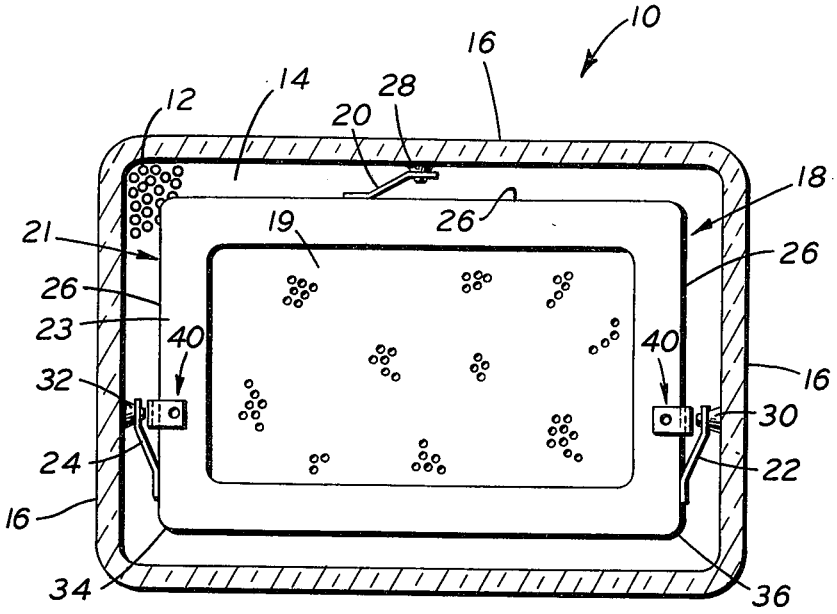
FIG. 1 is a sectional view of a color picture tube illustrating the invention.

Referring now to the drawings with greater particularity, there is shown in FIG. 1 a sectional view of a face plate 10 of a color cathode ray tube. Face plate 10 is substantially dish shaped and has a cathodoluminescent screen 12 (only partially shown) on the interior surface 14 thereof and is further provided with an upstanding peripheral wall 16. A typical shadow mask assembly 18 is shown mounted within face plate 10 by means of three leaf springs, 20, 22, 24 attached at one of their ends to the frame side wall 26 of the shadow mask assembly 18 and which have their apertured free ends releasably engaged with three studs 28, 30, 32 mounted within wall 16 approximately 120° apart. Mask assembly 18 is comprised of a relatively fragile, domed foraminated mask portion 19 surrounded by a relatively rigid circumferential frame 21 which has an instanding ledge 23 attached to one end of side wall 26. The foraminated mask portion 19 is attached to another end of frame side wall 26. As will be observed from FIG. 1, one of the springs, 20 in this instance, is attached to a long side of the rectangular mask assembly and the remaining two springs are located on the short sides, substantially oppositely disposed. This leaves the other long side of mask assembly 18 unsupported. Since, of necessity, there is a vacant area between the inside edge of wall 16 and mask assembly 18, it will be seen that a physical shock imparted against one of the short sides of the tube can cause the mask assembly to shift toward one of the short sides of the tube. This mask motion can be broken down into various vector components which when applied to the mask assembly 18 result in a twisting action about the 12:00 o'clock support stud (i.e., the stud 28 located in the long side of wall 16). This twisting action about the 12:00 o'clock stud, combined with the fact that corners 34 and 36 are held secure because of their respective support springs, causes the domed foraminated mask portion 19 to tend to buckle or elongate about either diagonal axis depending upon which short side the mask assembly 18 moves toward. This action places one diagonal axis of the fragile, domed mask surface under tension and the other in compression, and, if the force is severe enough, can result in collapse of the domed foraminated portion 19, rendering the tube inoperative.

Figure 2:
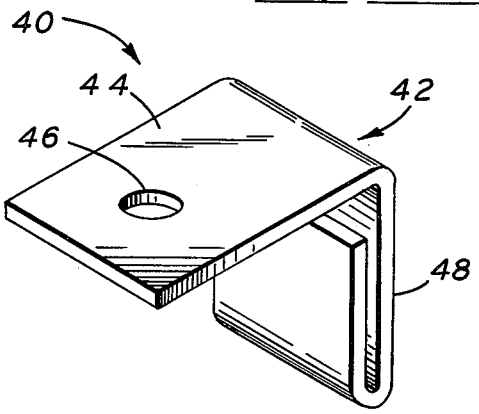
FIG. 2 is a perspective view of a movement limiting bracket.
Figure 3:
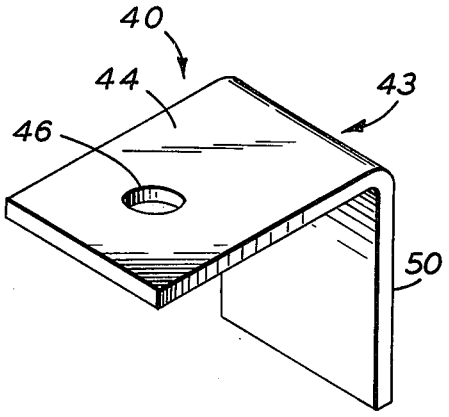
FIG. 3 is a perspective view of an alternate bracket which can be employed.

To substantially prevent the above-described occurrence the tube of this invention has incorporated therein means 40 for substantially preventing such transverse movement of mask assembly 18. FIGS. 2 and 3 show two such means which can be employed. The means 40 shown in FIG. 2 comprises an L shaped bracket 42 having one leg 44 thereof provided with an attachment aperture 46. The remaining leg 48 is shown as being bent back upon itself to form a spaced double wall which can provide a springing action in the event of impact.

FIG. 3 shows an alternate embodiment of a bracket 43 with but a single thickness of depending leg 50.

Figure 4:
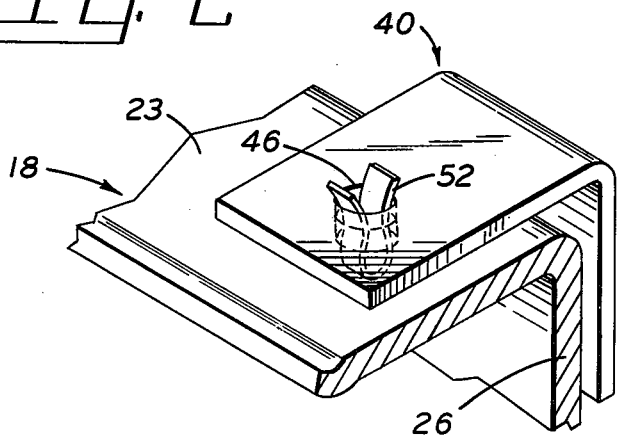
FIG. 4 is a perspective view of one method for attaching a bracket to the shadow mask frame.

The means 40 for restricting movement are preferably mounted as shown in FIG. 4. Herein, a spring clip 52 passes through attachment aperture 46 and through a corresponding aperture formed in ledge 23. Since the presence of the means 40 severely restricts the travel of springs 22 and 24, it is preferable not to install means 40 until the screen has been completely fabricated and it is no longer necessary to remove the mask assembly 18. It will, of course, be obvious to those skilled in the art that other forms of attachment, such as welding, can be used to attach means 40; however, care must be utilized to avoid contaminating the already formed screen with weld spatter or other debris.

It will be seen that employment of this invention can greatly reduce damage to the fragile domed mask caused by physical shocks imparted to a short side of the tube.

While there has been shown and described what is at present considered the preferred embodiment of the invention, it will be obvious to those skilled in the art that various changes and modifications may be made therein without departing from the scope of the invention as defined by the appended claims.

What is claimed is:

1. In a rectangular color picture tube of the shadow mask variety, said tube having a face plate portion with a luminescent screen formed on an interior surface thereof, said shadow mask being mounted within said face plate and comprising a relatively fragile foraminated portion affixed to a relatively rigid circumferential frame and wherein said mask is positioned in said face plate by means of three springs attached to said mask which cooperate with three studs affixed in walls of said face plate, one spring being attached to a long side of said mask and the other two springs being substantially oppositely disposed on the short side of said mask, the improvement comprising: means associated with said short side springs for substantially restricting movement of said mask in a direction transverse to the longitudinal axis of said tube, said means for restricting movement of said mask including at least one section that extends between said stud and said frame and is spaced from said frame.

2. The tube of claim 1 wherein said means for restricting movement are attached to said frame.

3. The tube of claim 1 wherein said foraminated portion has an upstanding wall which is attached to an upstanding wall of said frame and said frame includes a substantially planar flange which projects from said upstanding wall of said frame toward the interior of said tube and said means for restricting movement are attached to said flange.

4. The tube of claim 3 wherein said transverse movement restricting means comprise a pair of substantially L shaped brackets, one each associated with one each of said side springs, and having one leg of said bracket attached to said flange with the free leg extending toward said screen.

5. The tube of claim 4 wherein each of said brackets has its free leg doubled back upon itself.

* * * * *